United States Patent [19]

Strumskis

[11] 4,396,487

[45] Aug. 2, 1983

[54] PROCESS FOR RETORTING OIL SHALE AND THE LIKE

[75] Inventor: Louis Strumskis, Ocala, Fla.

[73] Assignee: Georgia Oil & Gas Company, Ocala, Fla.

[21] Appl. No.: 205,111

[22] Filed: Nov. 10, 1980

[51] Int. Cl.[3] ..... C10G 1/00; C10B 47/24; C10B 49/10; C10B 49/22

[52] U.S. Cl. ..... 208/8 R; 208/11 R; 201/2.5; 201/15; 201/20; 201/25; 201/27; 201/30; 201/38

[58] Field of Search ..... 208/8 R, 11 R; 201/2.5, 201/15, 20, 25, 27, 30, 38

[56] References Cited

U.S. PATENT DOCUMENTS

| | | | |
|---|---|---|---|
| 1,259,277 | 3/1918 | Palmer | 201/2.5 |
| 1,271,071 | 7/1918 | Palmer | 201/2.5 |
| 1,280,178 | 10/1918 | Day | 201/20 |
| 1,374,887 | 4/1921 | Sawtelle | 201/30 |
| 1,481,399 | 1/1924 | Webert | 201/2.5 |
| 1,538,954 | 5/1925 | Rosenthal | 201/15 |
| 1,838,548 | 12/1931 | Hoslam et al. | 208/8 R |
| 1,861,355 | 5/1932 | Owens | 208/8 R |
| 2,710,828 | 6/1955 | Scott, Jr. | 208/11 R |
| 2,832,725 | 4/1958 | Scott, Jr. | 208/11 R |
| 2,966,450 | 12/1960 | Kimbertin, Jr. et al. | 208/11 LE |
| 4,075,083 | 2/1978 | Putman | 208/341 |
| 4,088,562 | 5/1978 | O'Ffill | 208/11 R |
| 4,260,471 | 4/1981 | Miller | 208/8 R |
| 4,298,453 | 11/1981 | Schoennagel et al. | 208/8 R |
| 4,325,787 | 4/1982 | Strumskis | 208/11 R |

FOREIGN PATENT DOCUMENTS

| | | | |
|---|---|---|---|
| 10687 | of 1914 | United Kingdom | 201/25 |

*Primary Examiner*—Delbert E. Gantz
*Assistant Examiner*—Helane E. Maull
*Attorney, Agent, or Firm*—Millen & White

[57] ABSTRACT

The production of oil by retorting shale and other hydrocarbonaceous and lignocellulosic solid materials is facilitated by retorting in the presence of steam and acetic acid.

32 Claims, No Drawings

PROCESS FOR RETORTING OIL SHALE AND THE LIKE

BACKGROUND OF THE INVENTION

This invention relates to an improved retorting process for the production of oil from oil shale and like materials.

It has been known for many years that a refinable hydrocarbonaceous oil can be produced by retorting oil shale and other solid hydrocarbonaceous and lignocellulosic materials. The commercialization of such processes is intimately dependent upon the yield of oil obtained per ton of starting material, the cost of the capital equipment required to conduct the process and, to a lesser extent, upon the ecological impact of the process upon the surrounding environment. I have now found that an improved yield of oil of higher quality is achieved with lower energy consumption by conducting the retorting process in the presence of steam and acetic acid.

U.S. Pat. No. 2,966,450 (Kimberlin et al.) mentions the use of acetic acid in conjunction with solvents for extracting oil from shale, but states it is unsuitable for this purpose. U.S. Pat. No. 2,560,767 (Huff), U.S. Pat. No. 2,710,828 (Scott), U.S. Pat. No. 2,832,725 (Scott) and U.S. Pat. No. 4,075,083 (Putman) all disclose methods for retorting oil shale where the particulate solids are passed down through a treating vessel, through a preheating zone, and through zones of progressively higher temperatures. Huff discloses a means whereby hot air from the end of the process is recycled to the preheat zone.

SUMMARY OF THE INVENTION

In one aspect, this invention relates to a process for the production of a hydrocarbonaceous oil by heating a hydrocarbonaceous or lignocellulosic solid material to form a non-volatile residue and a distillate comprising a hydrocarbonaceous oil, which process comprises heating the starting solid material in the presence of steam and acetic acid.

In another aspect, this invention relates to a process for the thermal conversion of acetic acid into higher boiling distillable organic material comprising the steps of:

(a) passing a mixture of steam and acetic acid through a bed of hydrocarbonaceous or lignocellulosic solid material at a temperature effective to convert a portion of the organic material in the solid material into a distillable hydrocarbonaceous oil and another portion thereof and the acetic acid into a more hydrophilic distillable organic material and further effective to volatilize the thusproduced more hydrophilic organic material and the hydrocarbonaceous oil;

(b) separating the volatilized material from the residual non-volatile material;

(c) condensing the volatilized material;

(d) separating the more hydrophilic organic material from the hydrocarbonaceous oil; and (e) recovering the thus-produced more hydrophilic organic material and the hydrocarbonaceous oil.

DETAILED DISCUSSION

This invention is based upon the discovery that the yield of hydrocarbonaceous distillable oil produced by the destructive distillation of oil-bearing shale and other hydrocarbonaceous and lignocellulosic solid materials is increased by the introduction into such materials of both steam and acetic acid before the solid material is heated to its maximum temperature. Not only is the oil yield increased, e.g., up to 20% or more, but a superior quality of oil is produced which is more fluid and which contains less nitrogen. In the case of oil shale, oil yields of 110% of Fischer assay are common. This apparently is due to the acetic acid being a molecular catalyst which enters into a reaction with the kerogen organic material. Moreover, the acetic acid employed therein is converted into valuable higher boiling hydrophilic materials which can be recovered along with the oil. Such hydrophilic materials are of the carboxyl and longer-chained group of chemicals and can be separated from the aqueous phase by conventional methods, e.g., by the use of solvents, such as chloroform, in such volume and value as to make the recovery a worthwhile by-product recovery. Both the kind and the volume of by-product chemicals obtained vary widely with the oil shale material used. Novel products and additional chemicals are also obtained when acetic acid is used on lignite.

The process can be energy self-contained, i.e., the combustible gases produced in the process can be burned and the hot combustion gases used to heat the solid material to the desired final temperature. The process can also be conducted in an ecologically clean manner by using the residual non-volatile material as a purifying medium for the water condensed along with the thus-produced oil and the more hydrophilic distillable organic material, so that it can be re-used in the system. Moreover, whenever pieces of wood such as pine tops or that which is left over by crews that clean power lines is retorted, such biomass products produce a high quality methane base, a lignin which is different than the lignin extracted today (because this novel lignin is produced with a different specific gravity and with the much desired ability to chemically bond with other chemicals and substances). Also, when such biomass is retorted, the high quality activated charcoal produced therefrom can be used as the fuel to provide the heat in the retort. In this latter use, the low p.p.m. "spent" water can be passed through a reverse osmosis membrane to produce a pure water, which is inexpensive to process, because the charcoal can be thereafter air-dried and used as fuel in the retort. One such biomass which can be used to obtain good quality oil, gas and charcoal in the central part of the United States is milkweed, which can be harvested 3 times a year.

In carrying out the process of this invention, the starting solid material is heated from ambient temperature to a final temperature of at least 450° C., preferably at least 500° C., most preferably about 500° to 530° C., over a period of about 1 to 2 hours, preferably about 1.5 hours. The final temperature is substantially lower than that required to conduct the retorting process in the absence of steam and acetic acid.

The preferred starting material is oil bearing shale. Other solid hydrocarbonaceous and lignocellulosic materials, e.g., bituminous coal, tar sands, peat, and even sawdust, leaves and other waster lignocellulosic materials can be employed instead of oil bearing shale as starting material in the process of this invention.

Before reaching the maximum temperature, the solid material is mixed with both steam and acetic acid. Glacial or aqueous, e.g., 6%, 28%, 56%, 70% or 80%, acetic acid can be used. The amount of steam employed is preferably about 0.15 lbs. to 0.20 lbs., more preferably about 0.20 lbs., per pound of starting solid material. The amount of acetic acid employed is preferably about 0.015 lbs. to 0.03 lbs., more preferably about 0.02 lbs. (calculated as 100% acetic acid) per pound of starting solid material. In the case of oil bearing shale, about 5 gals. of glacial acetic acid per ton of shale is an optimal ratio.

The steam and acetic acid can be mixed with the solid material separately, at different points in the process, or preferably concomitantly at approximately the same point or points in the process. Preferably, a continuous stream of steam and of acetic acid is added to a continuous stream of particulate solid material. Preferably also, a portion of the steam and acetic acid is added to the solid material while at a lower temperature than that at which the remainder of the steam and acetic acid is added thereto. Most preferably, a portion of the steam and acetic acid is added to the starting solid material in a preheat zone in which the solid material is heated to a temperature above 100° C. but below the temperature at which the distillate is produced, preferably between 100° and 120° C. Desirably, the latter portion of steam and acetic acid is added at a point where the solid material is at a temperature of about 300° to 400° C., preferably at least about 400° C.

The reaction time can be varied widely, e.g., from 60 minutes to 2 hours. The optimum reaction time is inversely proportional to the final reaction temperature and the rate at which the solid material is heated thereto. Generally speaking, a reaction time of about 1 to 2 hours is sufficient to yield all of the volatile organic materials which can be produced from the starting solid material.

The reaction can be conducted batch-wise or preferably continuously.

When conducting the process batch-wise, the starting solid material, acetic acid and water can be mixed together prior to initiating heating thereof. When the temperature reaches 100° C. (or correspondingly higher, if the process is conducted under pressure), the water is converted to steam and most thereof is distilled off before any oil is produced, which usually does not occur below 200° C. Alternatively, only a portion of the acetic acid and only enough water to moisten the solid material can be mixed therewith prior to heating and the remainder passed therethrough after the mixture is heated above 200° C. and preferably above 300° C., or the starting raw material can be heated, e.g., above 100° C., preferably above 200° C., before one or both of the steam and acetic acid are mixed therewith.

Apparatus for conducting the process continuously is disclosed in my copending application Ser. No. 173,944, filed July 31, 1980 which issued on Apr. 20, 1982 as U.S. Pat. No. 4,325,787 whose disclosure is incorporated herein by reference.

In conducting the process continuously on a commercial scale, oil shale is comminuted to a convenient particle range, e.g., ranging from fines to particles of about ¼ inch in diameter. If tar sand is used, it can be mixed with other particulate hydrocarbonaceous or lignocellulosic solid material to render it less tacky and more flowable. The particulate solid material is then mixed with the acetic acid in the selected ratio. The beneficial effects of the acetic acid is not due merely to a lowering of the pH as strong mineral acids and higher fatty acids do not produce the beneficial results achieved with acetic acid.

As stated above, a portion of the acetic acid, e.g., from 30% to 60%, preferably about 50%, is desirably admixed with the starting particulate solid material prior to its being heated to about 120° C. This is conveniently accomplished before the solid material enters the retorting vessel, e.g., prior to or concurrently with the preheating of the starting solid material which preferably is conducted.

Similarly, a portion of the steam employed in the process, e.g., from 30% to 60%, preferably about 50%, is desirably admixed with the starting particulate solid material prior to its being heated to about 120° C. This is conveniently accomplished before the solid material enters the retorting vessel, e.g., prior to or concurrently with the step of pre-mixing the starting solid material with acetic acid. Such high moisture is a good conductor of heat within the solid material.

After preferably being preheated with a portion of the steam and premixed with a portion of the acetic acid employed in the process, the particulate starting material is gradually heated to a temperature at which destructive distillation of the organic material therein occurs, e.g., to at least 450° C., preferably about 500° to 550° C. Heating is preferably continued until substantially all of the volatilizable organic material has been removed from the particulate solid material. During the heating and before the solid material reaches a temperature above about 400° C., steam and acetic acid in the amounts required to catalyze the volatilization of the organic material therein are passed therethrough, preferably as a continuous stream.

The volatilized products are passed through one or more condensers to condense the volatilized liquids therein. When a plurality of successive condensers are employed, the liquid products can be fractionated so that all or most of the oil phase products are condensed before the aqueous phase products condense. Alternatively, all of the condensible products can be condensed together and the two phases separated by gravity or centrifugation.

The economics of the process are enhanced by collecting the combustible gases remaining after the condensible liquids are separated from the gaseous products produced in the process. These gases are of high quality and have an energy content of about 700 btu/cu. ft. Most oil bearing shale produces enough such gases to provide the requisite heat energy required to perform the process if conducted in insulated apparatus and heat losses are otherwise minimized.

The economics of the process are further enhanced by recovering the heat present in the spent particulate material. This can be done by passing the spent particulate material through a heat exchanger whereby the heat is transferred to incoming starting material, or to air used to burn the combustible gases and/or to the water used to form the steam employed in the process.

In addition to the low nitrogen content refinable oil produced in the process, solid hydrophilic organic products are also produced. When the separated aqueous and oil phases are cooled below about 22°, these products appear as suspended solids in both phases and can be separated by filtration or centrifugation. Further organics can be precipitated from the aqueous phase by the addition of a solvent, such as chloroform.

The preferred embodiment of the system disclosed in my prior filed application cited above comprises as the principle unit thereof a vertically disposed retort silo assembly. The apparatus associated therewith includes a receiver hopper for reception of the starting particulate raw material from, for example, a dump truck. The crushed oil shale or the like as deposited in the hopper is conveyed therefrom by an endless belt-type feed conveyor of a conventional nature, such as a bucket or plate flight type known in the art. The discharge end of the conveyor is in proximity to a vertically disposed endless belt type elevator which provides communication generally from the hopper to a discharge end. The elevator discharges raw material and dumps it into a bin, the lowermost surfaces of which are inclined and the bottom thereof discharges into an auger screw type feed conveyor which provides communication between the discharge opening of the bin and the interior of the retort. One large bin can support a pod of 5 to 10 silos. A baffle plate diverts the raw material from the conveyor downwardly into the retort. The retort chamber in which the crushed shale is received includes a vertically disposed hollow shaft which is mounted in a mercury bearing disposed at the lower end thereof. The shaft is driven in any suitable manner, for example by a vertically mounted electric motor and any suitable type drive mechanism, such as belts or gearing. An upper bearing positions the vertical shaft at its upper end. Disposed at periodic intervals along the linear extent of the vertical shaft in the retort are a plurality of horn-like arcuately shaped stirring fingers which are disposed to continuously agitate the shale and enhance migration of the crushed shale from the upper intake portion or zone of the retort to a retort spent solids discharge outlet. This function is additionally aided by gravity as the material is drawn off at the discharge outlet of the system. The particulate material within the retort migrates towards this discharge outlet and hence the reactions within the retort are of a continuous nature and extraction of the desired products of protroleum and other by-products of the chemical reactions carried out therein are of a progressive nature as the material moves downwardly through the interior of the retort. The lower portion of the retort housing is of a generally frustroconical configuration and a plurality of scraper blades mounted on positioning shafts, disposed at the lower portion of the shaft, effect a scraping movement against the inner wall of lower portion of the retort. A plurality of discharge shoevels, disposed immediately above the retort spent solids discharge outlet, direct the spent solids thereto. The materials falling through the spent solids discharge outlet are engaged by a screw type auger discharge conveyor, mounted within a housing, for movement horizontally to a conveyor discharge outlet for discharge of the material in any suitable manner, as by feeding to other conveyors, elevators or into the bed of dump trucks or railway hopper cars, as desired.

The retort has a dual wall structure for providing heat exchange functions from hot combustion gases passed between the spaced chamber walls thereof to the particulate material contained within the retort. The metal which comes in contact with the retort can be constructed of Carpenter 20 Ch-3 steel clad over T-22 structural steel or any other suitable material for both protection and strength. The external surface of the retort is covered by a layer of insulation to reduce heat loss. The heated walls distribute the heat throughout the outer parts of the retort chamber. Heat recovery fins may be made of copper and tied to a ring around the silo for better heat recovery. The outer shell metal may be made of steel and insulated with a suitable insulating material. The upper end of the heat exchange jacket formed by the dual walls of the retort is connected by conduits to provide fluid communication from the upper end of the heat recovery area of the retort to the outer shell of a steam boiler, disposed above the upper bearing assembly for the vertical shaft in the retort. The boiler is placed on top of the silo in such a manner as to utilize the escaping hot gases for heat recovery and greatest efficiency in the use of BTU's. The gaseous products which pass upwardly into the upper chmber area of the retort are carried off by an outlet conduit and passed through a condenser of a character well known in the art to a plurality of discharge conduits. Suitable valve arrangements are provided in the conduits for controlling the flow of condensed liquid into a pair of separator tanks. The lower end of the separator tanks are of a conical configuration and fitted above but proximate thereto are a pair of oil discharge conduits, each having discharge valves and being connected to each other by a "Y" connection for discharge into a crude oil storage tank.

Phase separation in the separator tanks can be facilitated by providing them with cooling jackets to further cool the liquids condensed in the condenser and/or by the use of centrifuges in lieu of or in conjunction with the separator tanks, which collect the distilled liquid and separate the same by action of the respective specific gravities into crude oil, which is discharged at the oil outlets and dirty water which discharges at the lowermost water outlets into a water discharge conduit. The crude oil storage tank also has a conical configuration at the lower end thereof and is fitted with a suitable discharge valve disposed at its outlet for controlled discharge of the crude oil contained therein to a suitable dispensing conduit. Fitted at the bottom of the separator tanks are a pair of valves which control the flow of dirty water from the lowermost point of the separator tanks. A "U"-shaped conduit provides fluid communication from the discharge valves via a conduit to a dirty water collection tank. The lower portion of the dirty water collection tank is provided with an inclined bottom which is elevated at the end remote from the discharge end for flow from the discharge outlet tube to a limestone briquette water neutralizer tank of a construction similar to that of the dirty water tank. The neutralizer tank also has an inclined bottom for enhancing flow to the discharge outlet tube thereof which in turn is connected to an activated charcoal filter tank unit.

The collected dirty water is run through limestone briquettes in the neutralizer tank to remove acidic elements and suspended solids therefrom. When the limestone is neutralized, it may be removed in order to extract water soluble materials, such as acetone, alcohol and acetic acid, therefrom. The inclined bottom thereof discharges into an effluent conduit which optionally is connected via pumping means to the water inlet of the steam boiler. A centrifuge can be disposed between the separator tanks and the dirty water collection tank to remove any solids suspended in the dirty water.

The upper ends of the separator tanks are each connected to a gas venting conduit through which the combustible gases vented therefrom are transported to a plurality of gas inlet conduits which are connected to a plurality of conventional gas burners, two of which are disposed adjacent to the tapered bottom portion of the retort, adjacent the scraper assemblies, in the interior of the spaced heat exchange chamber between the double walls of the retort, thereby to provide heating of the particulate material contained in the retort at various levels or zones thereof, and others of which are disposed in the housing of a preheat chamber surrounding the feed conveyor to preheat the particulate material before it enters the retort.

The interior of the retort heat exchanger portion is provided with a copper lining as shown at the frusto-conically shaped lower portion thereof for more efficient heat exchange. The housing of the discharge conveyor is enclosed by a chamber for heat recovery purposes.

Alternatively, the gas inlet conduits can be connected to suitable gas storage tanks and commercially available natural gas can be used in lieu of the vented gases or, alternatively, in combination therewith to fuel the gas burners.

The steam boiler is connected to a steam distribution system whereby steam is fed into the interior of retort, just above the frusto-conical lower portion thereof, by a conduit and to the interior of the housing surrounding the feed conveyor which is connected between the bin and the interior of the retort at or adjacent the discharge port. The outer housing of the heat exchanger also provides a preheat chamber for the gas burners therein which are in fluid connection to gas venting conduits with the venting conduits at the top of the separator tanks.

In the preferred embodiment, the housing of the feed conveyor is also connected to a first acetic acid storage tank whereby acetic acid is carried from the outlet of the tank into the interior of the feed conveyor housing for admixture along with the steam with the particulate raw material as it moves through the feed auger conveyor to the retort. An additional acetic acid dispensing tank and the steam distribution system are connected for fluid communication of steam and acetic acid with a lower portion of the retort by virtue of an inlet conduit which passes through the double walls of the retort. A shield is disposed at the entrance to the gas outlet conduit at the top of the retort to prevent any particules of raw material from entering the gas outlet. The weight of the raw material in the holding bin prevents the rearward escape of any gases from the feed conveyor.

The metal portions of the system which are contacted with the acetic acid are formed of a non-corrosive material.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

EXAMPLE I

Eastern Shale

Thoroughly mix 250 kg. of eastern shale (ground to a ¼ inch size) with a mixture of 100 liters of water and 5 liters of glacial acetic acid in an acid resistant reactor fitted with a water cooled condenser. Heat the mixture from ambient temperature (22° C.) to 102° C. in about 35 minutes, at which time water will begin to distill from the reactor. Raise the temperature of the shale to 120° C. over a period of about two hours, at which time about 100 liters of water will have distilled from the reactor. Raise the temperature of the shale to 530° C. over a period of about 2 hours, at which time about 19.5 liters of oil phase and about 7.5 liters of aqueous phase distillate is obtained. Cooling both phases to below 70° C. and centrifuging yields from the oily phase about 19 liters and from the "oily" and aqueous phases about one gallon of valuable solid organic products which were separated with a solvent (chloroform). The oil is a high quality refinable, petroleum-like oil of red color, high quality and free of ammonia odor. The yield thereof corresponds to 18.33 gallons per ton of shale. The non-condensible portion of the volatiles is a combustible gas which can be burned to heat the retort.

Following the same procedure but omitting the acetic acid yields about 17 liters of oil phase and about 8 liters of an aqueous phase, neither of which phases contain significant additional solid organics. In addition to a lower yield of oil than the run conducted with acetic acid, the oil is darker and of a lower quality. The yield thereof corresponds to 16.3 gallons per ton of shale. The acetic acid thus produces 14% more oil of higher quality than conducting the retorting process in the presence of steam only. Further, the carboxyl group-containing chemicals separated by the use of a solvent (chloroform) are very valuable.

EXAMPLE II

Pine Sawdust

Follow the procedure of Example I employing 125 kg. of moist pine sawdust (70 kg. dry weight), 100 liters of water and 5 liters of glacial acetic acid, heating from ambient temperature to 102° C. over a period of 2.75 hours; to 200° C. in 1.25 hours and to 465°-478° C. in about 3 hours. About 108 liters of water is collected as the temperature rises to 200° C. As the temperature rises further to about 460° C., about 43 liters of a mixture of water and naval stores, and lignin, is obtained. At the highest temperatures, about 2.3 liters of high quality diesel-like fuel oil is produced. The residue is high quality activated charcoal. The lignin produced is novel and extraordinary in that it bonds readily with other chemicals.

Conducting the same reaction in the absence of the acetic acid yields 113 liters of water; 33 liters of a mixture of water and naval stores; and 1.3 liters of fuel oil. Use the activated charcoal by-product to clean potable or secondary water prior to its use as fuel to provide the necessary heat for the retort.

EXAMPLE III

Peat

Following the procedure of Example I using peat and 4% by weight thereof of glacial acetic acid yields about 15 gallons of diesel-like fuel oil per ton of peat, plus solid distilled organics and copius amounts of combustible gas. If the acetic acid is omitted, the yield of oil drops to about 10 gallons, the quality thereof is lower and no significant amount of solid distilled organics and a lesser amount of combustible gas is produced.

EXAMPLE IV

Shale

Employing the retorting apparatus described herein which is the subject of my prior-filed application cited hereinabove, feed western shale ground to a particle size from ¼ inch to fines (1%) to a 40 ton capacity retort at a rate of 20 tons/hr. so that the shale has an average residence time in the retort of about 2 hours. In the preheater, mix the shale with 50 gallons/hr. of 100% acetic acid and 8,000 lbs/hr. of steam (400° C.). Burn combustible gases in the burners in the preheater at a rate such that the shale is heated by indirect heat exchange at a temperature of about 120° C. Burn combustible gases in the burners positioned between the double walls of the retort at a rate such that the shale is discharged from the retort at a temperature of about 530° C. About half way down the retort, above the frustoconical bottom portion thereof, introduce 50 gals/hr. of 100% acetic acid and 8,000 lbs/hr of steam (700° C.) into the shale, where it is at a temperature of about 500° C.

In a heat exchanger positioned around the discharge conveyor, cool the shale by indirect heat exchange to about 100° C. with air as it passes through the conveyor and mix the heated air with the combustible gases burned in the preheated and retort.

Transfer the exhaust gases exiting from the double wall heat exchange area of the retort to the shell side of the boiler to supply the steam used in the process. Pass the volatiles exiting from the retort through a condenser which cools the condensed liquids to about 20° C. Transport the residual combustible gases to the burners used to heat the preheater and the retort. Separate the aqueous phase of the condensed liquids from the oily phase by gravity or centrifugation. Cool the separated phases to about 20° C. and separate the solidified solids suspended therein, amounting to about 6,700 lbs/hr. in the oily phase and about 800 lbs/hr. in the aqueous phase. These solids are valuable organics which can be used to defray a substantial portion of the cost of the process. Transport the resulting about 840 gals./hr of the oily phase to a storage tank for storage prior to shipment to a refinery.

Pass the about 2,000 gals./hr. of aqueous phase successively through a sand bed, a limestone bed and a bed of activated charcoal. Transport the resulting clean water along with fresh make-up water to the tube side of the steam boiler.

Transport the residual non-condensed gases (about 22,400 cubic feet/hr.) containing about 700 btu/cu.ft. to the burners in the retort system to supply at least a portion of the combustible gases burned therein, using commercially available gas as needed in start-up operations and storing excess combustible gas produced in the process for scrubbing and sale.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the production of a hydrocarbonaceous oil by heating a hydrocarbonaceous or liquocellulosic solid material to form a non-volatile residue and a distillate comprising a hydrocarbonaceous oil, the improvement which comprises mixing the starting material with steam and acetic acid prior to and during the formation of the distillate in amounts effective to increase the amount of distillate thus produced and heating the resulting mixture to a final temperature of at least 450° C.

2. A process according to claim 1 wherein the starting solid material is particulate.

3. A process according to claim 1 wherein a continuous stream of the starting solid material is heated to successively higher temperatures to a final temperature of at least 450° C.

4. A process according to claim 2 wherein the heating of the starting solid material is conducted ex situ in a retorting zone.

5. A process according to claim 1 wherein the starting solid material is oil shale, coal, tar sands, peat or sawdust.

6. A process according to claim 5 wherein the starting solid material is oil shale.

7. A process according to claim 1 wherein a continuous stream of steam and of acetic acid is added to a continuous stream of particulate solid material.

8. A process according to claim 7 wherein a portion of the steam and acetic acid is added to the solid material while at a lower temperature than that at which the remainder of the steam and acetic acid is added thereto.

9. A process according to claim 8 wherein a portion of the steam and acetic acid is added to the starting solid material in a preheat zone in which the solid material is heated to a temperature above 100° C. but below the temperature at which the distillate is produced.

10. A process according to claim 9 wherein heat from the non-volatile residue is employed to produce the steam employed in the process.

11. A process according to claim 1 wherein the amount of acetic acid employed is from 1.5% to 3% by weight of the starting solid material.

12. A process according to claim 1 wherein particulate oil shale is heated ex situ in a retorting zone to a final temperature of at least 450° C. and a portion of the acetic acid which is added thereto is added in a preheat zone in which the solid material is heated to a temperature above 100° C. but below the temperature at which the distillate is produced and the remainder is added in the retorting zone at a point therein where the shale is at a temperature which is below the maximum to which the shale is heated.

13. A process according to claim 12 wherein a continuous stream of steam and of acetic acid is added to a continuous stream of particulate solid material.

14. A process according to claim 12 wherein heat from the non-volatile residue is employed to produce the steam employed in the process.

15. A process according to claim 12 wherein combustible gases produced in the process are collected and burned to provide at least a portion of the heat employed to heat the solid material.

16. In a process for the production of a hydrocarbonaceous oil by heating a hydrocarbonaceous or lignocellulosic solid material to form a non-volatile residue and a distillate comprising a hydrocarbonaceous oil, the improvement which comprises preheating the starting solid material and subsequently forming the non-volatile residue and distillate by heating the preheated solid material and injecting steam and acetic acid into the heated solid material.

17. A process according to claim 16, further comprising conducting the preheating the starting solid material in the presence of steam and acetic acid.

18. A process for the thermal conversion of acetic acid into a higher boiling distillable organic material comprising the steps of:

(a) passing a mixture of steam and acetic acid through a bed of hydrocarbonaceous or lignocellulosic solid material at a temperature effective to convert a portion of the organic material in the solid material into a distillable hydrocarbonaceous oil and another portion thereof and the acetic acid into a more hydrophilic distillable organic material and further effective to volatilize the thus-produced more hydrophilic organic material and the hydrocarbonaceous oil;

(b) separating the volatilized material from the residual non-volatile material;

(c) condensing the volatilized material;

(d) separating the more hydrophilic organic material from the hydrocarbonaceous oil; and (e) recovering the thus-produced more hydrophilic organic material and the hydrocarbonaceous oil.

19. A process according to claim 18 wherein the starting solid material is oil shale, coal, tar sands, peat or sawdust.

20. A process according to claim 18 wherein the starting solid material is oil shale.

21. A process according to claim 18 wherein the starting solid material is tar sand.

22. A process according to claim 18 wherein the starting solid material is lignocellulosic.

23. A process according to claim 18 wherein a portion of the steam and acetic acid is added to the solid material while at a lower temperature than that at which the remainder of the steam and acetic acid is added thereto.

24. A process according to claim 18 wherein a portion of the steam and acetic acid is added to the starting solid material in a preheat zone in which the solid material is heated to a temperature above 100° C. but below the temperature at which the distillate is produced.

25. A process according to claim 18 wherein heat from the non-volatile residue is employed to produce the steam employed in the process.

26. A process according to claim 18 wherein the amount of acetic acid employed is from 1.5% to 3% by weight of the organic content of the starting solid material.

27. A process according to claim 1 wherein a stream of particulate oil shale is heated to a final temperature of at least 450° C. and a portion of the acetic acid which is passed through the solid material at a temperature below 100° C. and the remainder is added at a temperature which is below the maximum to which the shale is heated.

28. A process according to claim 27 wherein a continuous stream of steam and of acetic acid is added to a continuous stream of particulate solid material.

29. A process according to claim 27 wherein heat from the non-volatile residue is employed to produce the steam employed in the process.

30. A process according to claim 27 wherein combustible gases produced in the process are collected and burned to provide at least a portion of the heat employed to heat the solid material.

31. A process according to claim 22 wherein the starting material is lignocellulosic and the activated charcoal produced therefrom is used to clean contaminated water.

32. A process according to claim 20 wherein spent activated charcoal used to clean the water is burned to provide at least a portion of the heat employed to heat the solid material.

* * * * *